US008059116B2

(12) United States Patent
Ishizuka

(10) Patent No.: US 8,059,116 B2
(45) Date of Patent: Nov. 15, 2011

(54) ACTIVE MATRIX DISPLAY DEVICE

(75) Inventor: Shinichi Ishizuka, Tsurugashima (JP)

(73) Assignee: Pioneer Corporation, Tokyo (JP)

( * ) Notice: Subject to any disclaimer, the term of this patent is extended or adjusted under 35 U.S.C. 154(b) by 975 days.

(21) Appl. No.: 11/988,801

(22) PCT Filed: Jul. 13, 2006

(86) PCT No.: PCT/JP2006/314324

§ 371 (c)(1),
(2), (4) Date: Jan. 15, 2008

(87) PCT Pub. No.: WO2007/010956

PCT Pub. Date: Jan. 25, 2007

(65) Prior Publication Data

US 2009/0058843 A1 Mar. 5, 2009

(30) Foreign Application Priority Data

Jul. 20, 2005 (JP) ..... 2005-209588

(51) Int. Cl.
*G09G 5/00* (2006.01)

(52) U.S. Cl. ..... 345/213; 345/73; 345/211

(58) Field of Classification Search ..... 345/76, 345/82, 211–213
See application file for complete search history.

(56) References Cited

U.S. PATENT DOCUMENTS 6,583,775 B1 6/2003 Sekiya et al.
7,158,105 B2 1/2007 Miyazawa
7,880,690 B2 2/2011 Miyazawa
2002/0195968 A1 12/2002 Sanford et al.
2002/0196212 A1* 12/2002 Nishitoba et al. ..... 345/76
2003/0132931 A1 7/2003 Kimura et al.
2004/0108983 A1* 6/2004 Tseng et al. ..... 345/82
2005/0083270 A1* 4/2005 Miyazawa ..... 345/76
2005/0093791 A1* 5/2005 Lo ..... 345/82
2006/0071887 A1* 4/2006 Chou ..... 345/82
2006/0221004 A1* 10/2006 You et al. ..... 345/76
2011/0018855 A1 1/2011 Miyazawa

FOREIGN PATENT DOCUMENTS

CN 1591104 A 3/2005
JP 2000-347622 12/2000
JP 2001-60076 3/2001
JP 2002-514320 5/2002

(Continued)

OTHER PUBLICATIONS

S. J. Zilker, C. Detcheverry, E. Cantatore, and D. M. de Leeuw, "Bias stress in organic thin-film transistors and logic gates", Applied Physics Letters vol. 79(8) pp. 1124-1126, Aug. 20, 2001. Taiwanese Office Action dated Mar. 17, 2011, with partial English translation.

*Primary Examiner* — Amare Mengistu
*Assistant Examiner* — Premal Patel
(74) *Attorney, Agent, or Firm* — McGinn IP Law Group, PLLC

(57) ABSTRACT

A two-terminal switching device provided on each of a plurality of pixel units and connected at a first terminal to a control electrode of a drive transistor, the two-terminal switching device being transferred to a conductive state according to magnitude of the voltage applied to a second terminal to supply the applied voltage to the control electrode; and a reverse bias voltage applying unit for adjusting the voltage applied to the second terminal and applying a reverse bias voltage to the drive transistor are provided.

10 Claims, 12 Drawing Sheets

FOREIGN PATENT DOCUMENTS

| | | |
|---|---|---|
| JP | 2002-351401 | 12/2002 |
| JP | 2003-202833 | 7/2003 |
| JP | 2004-170815 | 6/2004 |
| JP | 2004-531772 | 10/2004 |
| JP | 2005-4174 | 1/2005 |
| JP | 2005-99715 | 4/2005 |
| JP | 2005-99773 | 4/2005 |
| TW | I243348 B | 11/2005 |

* cited by examiner

- RELATED ART -

- RELATED ART -

ACTIVE MATRIX DISPLAY DEVICE

TECHNICAL FIELD

The present invention relates to a display device including an active element for driving a light-emitting device such as an Electroluminescent (EL) device or light-emitting diode (LED) and, more particularly, to a display device including a thin film transistor (TFT) using amorphous silicon or an organic semiconductor as the active element.

BACKGROUND ART

A TFT is used widely as an active element for driving an active matrix type display such as an Organic EL display or a liquid-crystal display. FIG. 1 shows one pixel PLi,j as an example of an equivalent circuit of a drive circuit of the Organic EL device (OEL) 100. Referring now to FIG. 1, the equivalent circuit includes two P-channel TFTs 101, 102 as the active elements and a capacitor (Cs) 104. The scanning line Ws is connected to a gate of the selection TFT 101, a data line Wd is connected to a source of the selection TFT 101, and a power source line Wz for supplying a constant power-source voltage Vdd is connected to a source of the drive TFT 102. A drain of the selection TFT 101 is connected to a gate of the drive TFT 102, and the capacitor 104 is formed between the gate and the source of the drive TFT 102. An anode of the OEL 100 is connected to the drain of the drive TFT 102, and a cathode thereof is connected to an earth potential (or a common potential) respectively.

When a selection pulse is applied to the scanning line Ws, the selection TFT 101 as a switch is turned on and the TFT is conducting between the source and the drain. At this time, a data voltage is supplied from the data line Wd through a section between the source and the drain of the selection TFT 101, and is accumulated in the capacitor 104. Since the data voltage accumulated in the capacitor 104 is applied between the gate and the source of the drive TFT 102, a drain current Id according to a gate-source voltage Vgs of the drive TFT 102 flows and is supplied to the OEL 100.

However, it is known that a phenomenon such that a threshold voltage Vth is shifted when a voltage is continuously applied to the gate, that is, a phenomenon called "gate stress" may occur in a case of the TFT using amorphous silicon or an organic semiconductor. For example, see a reference document S. J. Zilker, C. Detcheverry, E. Cantatore, and D. M. de Leeuw, "Bias stress in organic thin-film transistors and logic gates", Applied Physics Letters Vol. 79(8) pp. 1124-1126, Aug. 20, 2001 (hereinafter, referred to as a non-patent document-1). This phenomenon will be described with taking the P-channel TFT as an example.

FIG. 2 shows an appearance of the shift of the threshold voltage Vth due to the gate stress. In the case of the P-channel TFT, when the gate-source voltage is set to a negative polarity (that is, Vgs<0) and is continuously applied, the Id-Vgs characteristics change in a negative direction (from a curved line 120A to a curved line 120B) as shown in FIG. 2 over time due to the gate stress, whereby the threshold voltage Vth is shifted from Vth1 to Vth2. In FIG. 2, the Vgs is assumed to be a positive value (Vgs>0) for the easiness of understanding.

In the change of characteristics of the TFT, the original threshold voltage Vth is restored by setting the gate-source voltage Vgs to 0V or a positive polarity and continuously applying the same. In contrast, when the Vgs is set to the positive polarity and applying continuously the same, the threshold voltage Vth is shifted to the positive direction over time, and when the Vgs is set to 0V or the negative polarity and applying continuously the same, the original threshold voltage Vth is restored. The shift amount increases with increase in absolute value of the gate-source voltage Vgs and the duration of application thereof. When the TFT having such characteristics is used for driving the Organic EL device, the threshold voltage Vth is shifted gradually during display.

The shift of the threshold voltage may disadvantageously result in lowering of luminance of OEL or malfunction of the TFT.

Single-crystal silicone, amorphous silicon, polycrystalline silicone or low temperature polycrystalline silicone are widely used as material for forming the TFT. Recently, a TFT formed of organic material (hereinafter, referred to as "Organic TFT") as an active layer instead of these silicon materials attracts public attention. Low molecular or high molecular organic material in which mobility of carrier is relatively high such as Penthacene, Naphthacene, or Polythiophene system material is exemplified as materials of the organic semiconductor. Since the organic TFT of this type may be formed on a flexible film substrate, such as plastic, with a process of relatively low temperature, a mechanically flexible, light-weight, and thin-model display can be manufactured easily. The organic TFT can be formed relatively at a low cost by a printing process or a roll-to-roll process.

The above-described threshold voltage shifting phenomenon appears remarkably in particular in the amorphous silicon TFT or the Organic TFT. The shift of the threshold voltage in the Organic TFT is disclosed, for example, in the above-described non-patent document-1 (S. J. Zilker, C. Detcheverry, E. Cantatore, and D. M. de Leeuw, "Bias stress in organic thin-film transistors and logic gates", Applied Physics Letters Vol. 79(8) pp. 1124-1126, Aug. 20, 2001).

The drive circuit for compensating the shift of the threshold voltage of the TFT and a drive method are disclosed, for example, in Japanese Laid-open Patent Application No. 2002-514320 (hereinafter, referred to as a patent document-1) and No. 2002-351401 (hereinafter, referred to as a patent document-2). The drive circuits and drive methods described in these documents are capable of regulating luminance of the light-emitting device irrespective of the shift of the threshold voltage of the drive TFT while allowing the shift of the threshold voltage of the same. However, since the drive circuits in these reference documents cannot constrain generation of the shift of the threshold voltage, increase in power consumption due to the shift of the threshold voltage cannot be prevented. When the shift of the threshold voltage of the drive TFT exceeds an allowable range, it is difficult to compensate the shift, and fluctuations in luminance or the malfunction of the TFT may be resulted. In addition, since the shift of the threshold voltage occurs in the selection TFT other than the drive TFT, when the shift of the threshold voltage in the selection TFT exceeds the allowable range, malfunction of the selection TFT may be resulted. In particular, the shift of the threshold voltage of the Organic TFT is larger than that of the low-temperature polysilicon TFT or the single-crystal silicon TFT, the fluctuations in luminance of the light-emitting device or the malfunctions of the TFT may easily be occurred in the case of the active matrix type display in which the organic TFT is used.

A configuration in which a connection of the source or the drain of the drive TFT and the capacitor with respect to the scanning line is contrived to avoid fluctuation in characteristics of the TFT (see, Japanese Laid-open Patent Application No. 2004-170815: patent document-3) and a connecting structure of the TFT for reducing the shift of the threshold voltage of an α-Si transistor (see, Japanese Laid-open Patent Application No. 2005-004174: patent document-4) are disclosed.

However, the drive circuits and methods disclosed in the above-described documents have a problem such that the configuration and operation of the circuit are complicated, and the effects thereof are limited.

DISCLOSURE OF THE INVENTION

The above-described disadvantages are exemplified as problems to be solved by the present invention. It is an object of the present invention to provide a display device in which characteristics of a transistor used in an active matrix drive system, in particular, of amorphous silicon or an organic semiconductor transistor can be improved. It is another object of the present invention to solve fluctuations in characteristics in a threshold value of the transistor and provide a display device with low power consumption, high display quality, and simple circuit configuration and operation.

According to the claimed invention recited in claim 1, there is provided a display device including: an active matrix display panel including a plurality of pixel units each having a light-emitting device, a capacitor for holding a data signal, and a drive transistor for driving the light-emitting device on the basis of the held data signal; a scanning unit for performing sequential line scanning for the respective scanning lines of the display panel; a data drive unit for supplying the data signal to the pixel units according to the scanning of the scanning unit; and a power source for supplying a voltage for driving the light-emitting device to the light-emitting device, the display device further including: a two-terminal switching device provided on each of the plurality of pixel units and connected at a first terminal to a control electrode of the drive transistor, the two-terminal switching device being turned on according to magnitude of the voltage applied to a second terminal to supply the applied voltage to the control electrode; and a reverse bias voltage applying unit for adjusting the voltage applied to the second terminal and applying a reverse bias voltage to the drive transistor.

According to the claimed invention recited in claim 11, there is provided a display device including: an active matrix display panel including a plurality of pixel units each having a light-emitting device, a capacitor for holding a data signal, and a drive transistor for driving the light-emitting device on the basis of the held data signal; a scanning unit for carrying out sequential line scanning for the respective scanning lines on the display panel; and a data drive unit for supplying the data signal to the pixel unit according to the scanning of the scanning unit, the display device further including: a two-terminal switching device provided on each of the plurality of pixel units and connected at a first terminal to a control electrode of the drive transistor and at a second terminal to a scanning line scanned previously by the scanning unit, the two-terminal switching device being turned on according to magnitude of a scanning voltage applied to the second terminal to supply the scanning voltage to the control electrode, wherein the scanning unit carries out sequential line scanning by a scanning pulse signal having a bias voltage of magnitude which can set the drive transistor into a reversely biased state.

EMBODIMENTS FOR CARRYING OUT THE INVENTION

Figure 1:
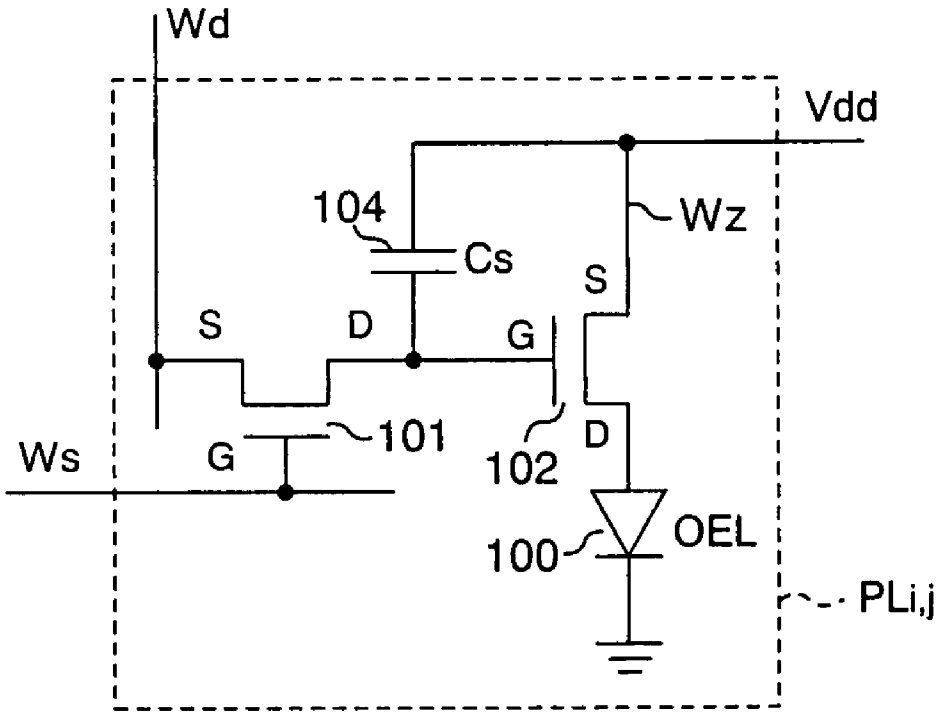
FIG. 1 is a drawing showing an example of an equivalent circuit of a light-emitting device drive circuit in the related art.
Figure 2:
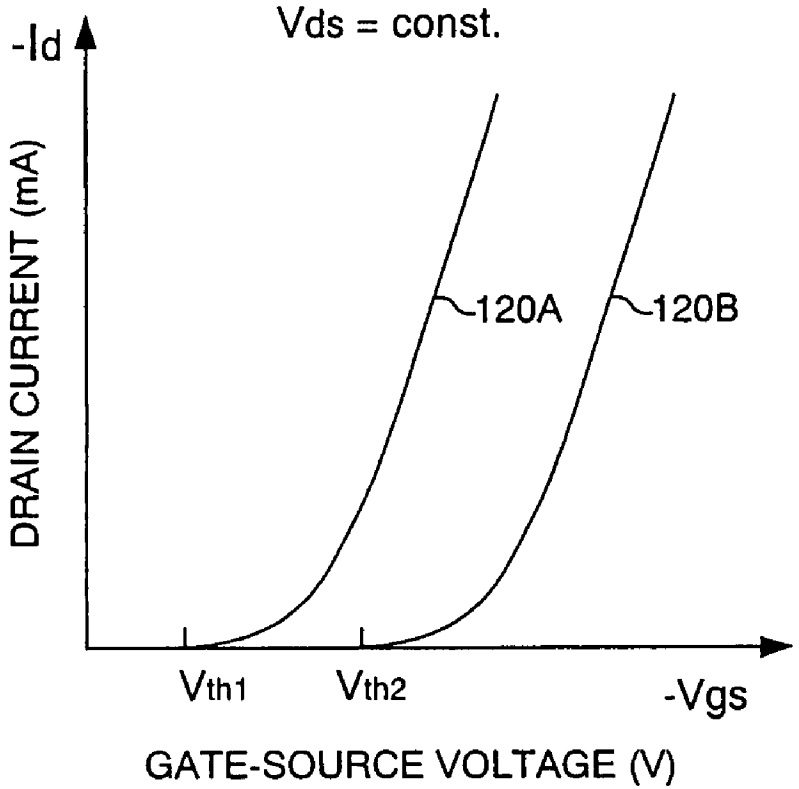
FIG. 2 is a drawing showing an appearance of shift of a threshold voltage Vth due to a gate stress.

Referring now to the drawings, embodiments of the present invention will be described in detail below. In the drawings described below, the substantially same parts are represented by the same reference numerals.

First Embodiment

Figure 3:
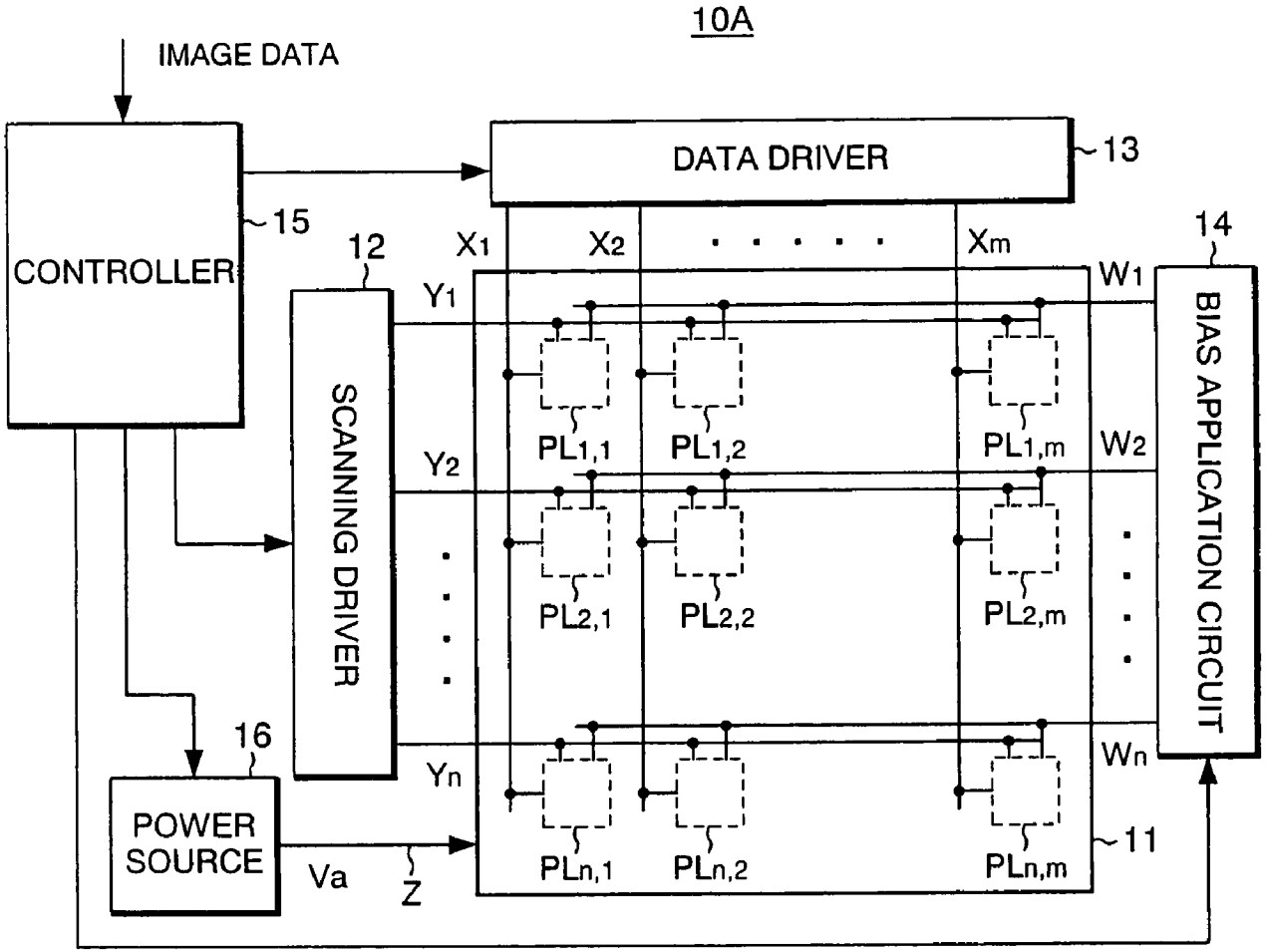
FIG. 3 is a block diagram of a display device using an active matrix display panel as a first embodiment of the present invention.

FIG. 3 shows a display device 10A using an active matrix display panel according to the present invention. The display device 10A includes a display panel 11, a scan driver 12, a data driver 13, a bias application circuit 14, a controller 15, and a light-emitting device drive power source 16 (hereinafter, also simply referred to as "power source").

The display panel 11 is of the active matrix type composed of m×n (m, n are 2 or larger integers) pixels, and includes a plurality of data lines X1 to Xm (Xi: i=1 to m) arranged in parallel to each other, a plurality of scanning lines Y1 to Yn (Yj: j=1 to n), and a plurality of pixel units $PL_{1,1}$ to $PL_{n,m}$. The pixel units $PL_{1,1}$ to $PL_{n,m}$ are arranged at a position of intersection between the data lines X1 to Xm and the scanning lines Y1 to Yn, and all of them have the same configurations. The pixel units $PL_{1,1}$ to $PL_{n,m}$ are connected to a power source line Z. The power source line Z receives a supply of a light-emitting device drive voltage (Va) from the power source 16.

Connecting lines (bias lines) W1 to Wn corresponding to the scanning lines Y1 to Yn respectively are also provided. As described in detail later, a predetermined magnitude of applied voltage is supplied to the bias lines W1 to Wn from the bias application circuit 14 at predetermined timings for the respective bias lines.

Figure 4:
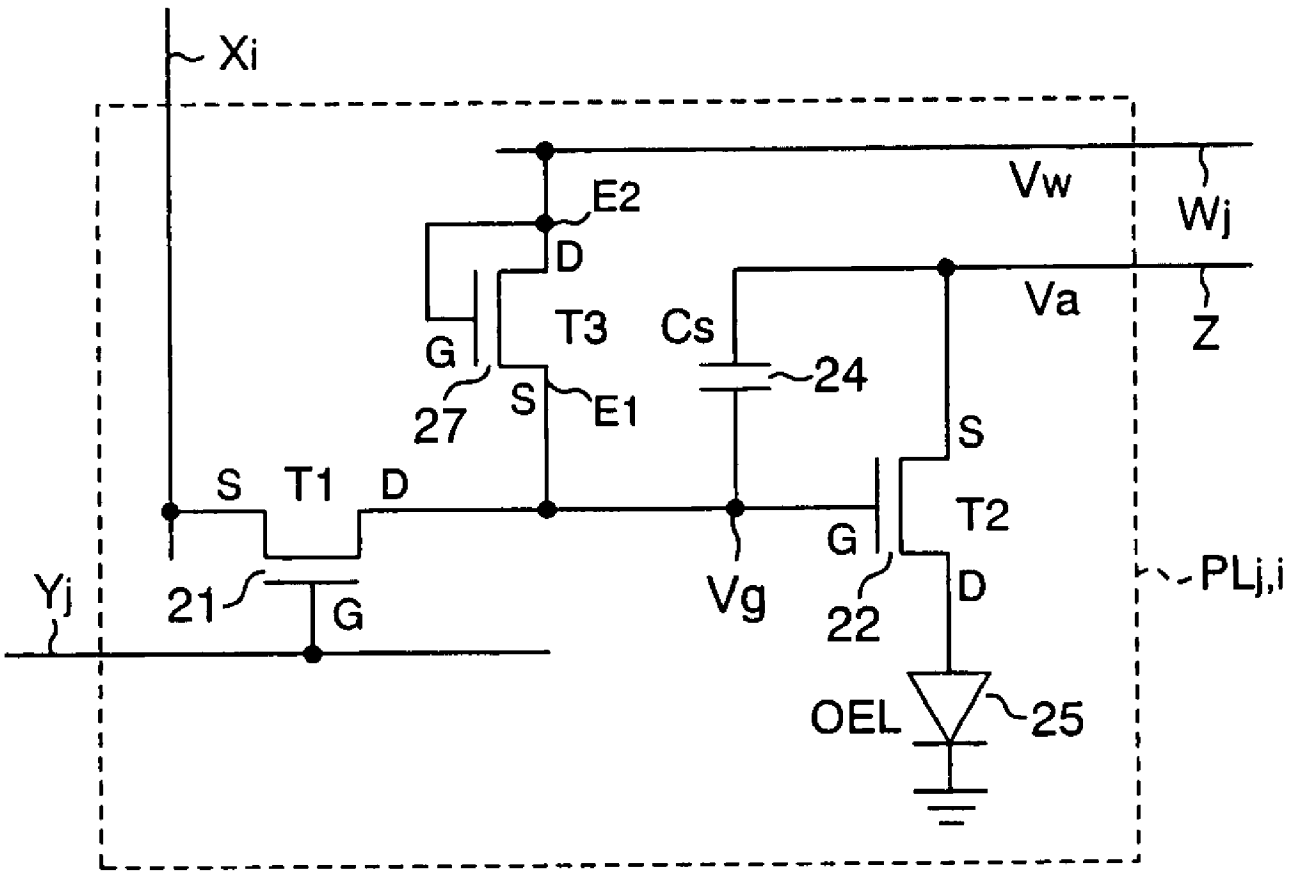
FIG. 4 is a drawing showing a pixel unit $PL_{j,i}$ relating to a data line Xi and a scanning line Yj in a plurality of pixel units in the display panel.

FIG. 4 shows the pixel units $PL_{j,i}$ relating to the data line Xi (i=1, 2, . . . , m) and the scanning line Yj (j=1, 2, . . . n) out of the plurality of pixel units in the display panel 11. More specifically, a selection transistor 21, a drive transistor 22, a data holding capacitor (Cs) 24, a light-emitting device 25, and a bias application transistor 27 are provided. In this embodiment, a case in which an Organic Electroluminescence device (OEL) is used as the light-emitting device 25, a P-channel TFT (thin film transistor) is used as the transistor 21, 22, and a N-channel TFT is used as the transistor 27 will be described as an example. The conduction types of the transistors 21, 22, 27 are not limited thereto, and may be selected as needed. The light-emitting device and the transistor are not limited to those using organic materials and the light-emitting device on the basis of amorphous silicon (α-Si) or other semiconductors, a bipolar transistor, or other types of transistors may also be employed. The polarity and magnitude of the various signals and a power-source voltage, such as the scanning signal, the data signal, the bias voltage, the light-emitting device drive voltage may be selected as needed according to the transistor used, the material and the conduction type of the light-emitting device.

A gate of the selection TFT (first transistor T1) 21 is connected to the scanning line Yj (j=1 to n), and a source thereof is connected to the data line Xi. A gate (control electrode) of the drive TFT (second transistor T2) 22 is connected to a drain of the selection TFT 21. A source of the drive TFT 22 is connected to the power source line Z, and a power-source voltage (positive voltage Va) is supplied from the power source 16. A drain of the drive TFT 22 is connected to an anode of the Organic EL device (OEL) 25. A cathode of the EL device 25 is connected to the ground.

One end of the data holding capacitor (Cs) 24 is connected to the gate of the drive TFT 22 (and the drain of the selection TFT 21), and the other end is connected to the source of the drive TFT 22 (and the power source line Z).

In this embodiment, the third transistor (T3) 27 as a switching device for performing switching for bias voltage application is provided. The switching transistor 27 has a diode connecting configuration. More specifically, a source of the switching transistor 27 is connected to the gate of the drive TFT 22. In other words, it functions as a first terminal (electrode E1) of a two-terminal switching device. A drain and a gate of the switching transistor 27 are connected to each other. In other words, the drain and the gate of the switching transistor 27 function as a second terminal (electrode E2) of the two-terminal switching device. In other words, the switching transistor 27 is connected to the second terminal (electrode E2) so that the direction in which a positive voltage is applied to the second terminal (electrode E2) is the forward direction.

A diode can also be used instead of the transistor as the switching device. An applied voltage from the bias application circuit 14 via the bias line Wj is supplied to the drain and the gate of the switching transistor 27. The applied voltage is a voltage for setting the drive TFT 22 into a reversely biased state, and the applied voltage is referred to as "diode drive voltage (Vw)" hereinafter.

The scanning lines Y1 to Yn in the display panel 11 are connected to the scan driver 12, and the data lines X1 to Xm are connected to the data driver 13. The controller 15 generates a scan control signal and a data control signal for controlling the display of the display panel 11 according to an input video signal. The scan control signal is supplied to the scan driver 12 and the data control signal is supplied to the data driver 13.

The scan driver 12 supplies display scanning pulses to the scanning line Y1 to Yn at predetermined timings according to the scan control signal delivered from the controller 15, whereby the line-sequential scanning is carried out.

The data driver 13 supplies pixel data signals for the respective pixel units located on the scanning line to which the scanning pulse is supplied according to the data control signal delivered from the controller 15 to the pixel units (selected pixel units) via the data lines X1 to Xm. For the pixel units which do not emit light, a pixel data signal of a level which does not cause the EL device to emit light is supplied.

The controller 15 controls the entire display device 10A, that is, controls the scan driver 12, the data driver 13, the bias application circuit 14, and the light-emitting device drive power source 16.

Figure 5:
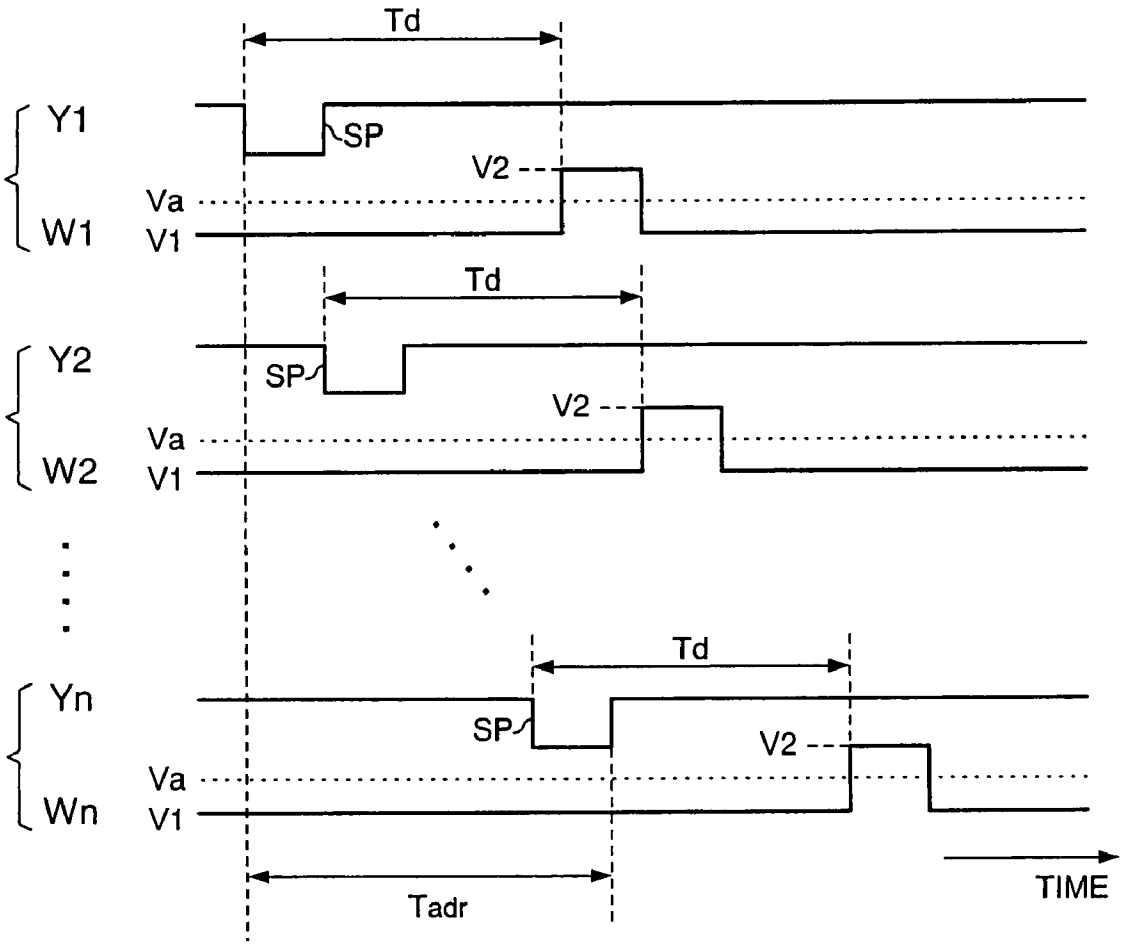
FIG. 5 is a timing chart schematically showing application timings of scanning pulses applied to respective scanning lines Y1 to Yn in the display panel and diode drive voltages Vw applied to bias lines W1 to Wn.

FIG. 5 is a timing chart schematically showing the application timing of the scanning pulses applied to the respective scanning lines Y1 to Yn and the diode drive voltages Vw applied to the bias lines W1 to Wn in the display panel 11.

In respective frames of the input video signals, scanning pulses SP are applied in sequence to the first to the $n^{th}$ scanning lines (Y1 to Yn) to carry out the sequential line scanning. A scanning time required for one frame is an address period (Tadr). Then, data signals DP which indicate luminance for the respective pixels are applied via the data lines X1 to Xm (not shown) corresponding to the sequential line scanning, so that control of the image display on the display panel 11 is achieved.

More specifically, the diode drive voltage Vw=V1 (hereinafter, referred to as "first diode drive voltage", or "first voltage") to be applied to the switching transistor 27 at the time of display operation is supplied to the bias line Wj (j=1 to n). The first diode drive voltage is set to a voltage which does not turn on the switching transistor 27 (the switching transistor 27 is OFF). More specifically, the diode drive voltage V1 to be applied at the time of the display operation is set to a predetermined voltage of magnitude at which the drive TFT 22 can drive the light-emitting device (Organic EL device 25) to emit light when the data signal voltage (Vdata) is applied to the gate of the drive TFT 22.

After a predetermined time period (Td) is elapsed from the initiation of application of the scanning pulse SP to the scanning line Yj (j=1 to n), the diode drive voltage (Vw) is increased from the first voltage to a second diode drive voltage (hereinafter, also simply referred to as "second voltage") V2 by the bias application circuit 14 via the bias line Wj (j=1 to n) (that is, Vw=V2>V1). Light emission from the Organic EL device 25 is stopped by the application of the second diode drive voltage V2. Therefore, as described in detail later, the predetermined time period (Td) corresponds to a light-emitting time period of the Organic EL device 25.

Figure 6:
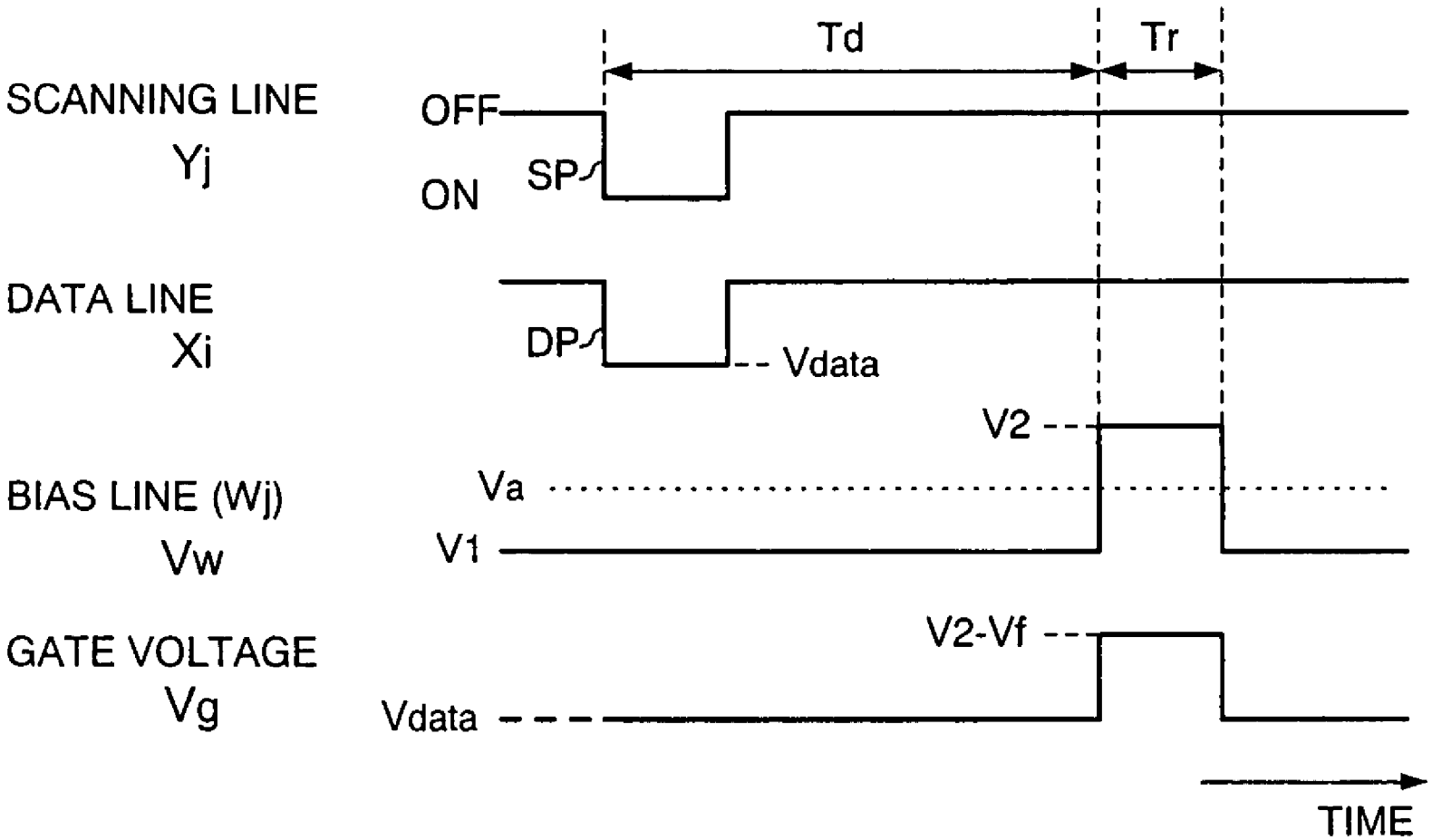
FIG. 6 is a drawing showing a scanning pulse, a data signal, a diode drive voltage and a gate voltage of a drive TFT applied to the pixel unit $PL_{j,i}$ on the scanning line Yj.

Subsequently, referring now to FIG. 6, the diode drive voltage Vw of the respective pixel units, and a gate voltage and a gate-source voltage of the drive TFT 22 will be described in detail. In FIG. 6, description will be made relating to the $j^{th}$ scanning line Yj (j=1 to n) as an example.

When the scanning pulse SP is applied to the scanning line Yj of the pixel unit $PL_{j,i}$ and the scanning line Yj is selected, the selection TFT 21 is turned on, and the pixel data signal pulse DP (data voltage Vdata) from the data driver 13 is supplied to the gate of the drive TFT 22 via the selection TFT 21. Since the power-source voltage Va (>0) is supplied to one of the electrodes of the capacitor (Cs) 24, an electric charge corresponding to a voltage Va−Vdata is accumulated in the capacitor 24, and a voltage corresponding to the electric charge is held (referred to as "holding voltage"). Then, the gate as the control electrode of the drive TFT 22 is controlled by the holding voltage. More specifically, a drain current according to the gate-source voltage Vgs (=Vdata−Va<0) flows to the drive TFT 22. Therefore, the light-emitting device (OEL) 25 is driven according to the pixel data signal (data voltage Vdata) and emits light.

After the predetermined time (Td) is elapsed from the initiation of application of the scanning pulse SP, the applied voltage to the bias line Wj is changed, and the diode drive voltage Vw becomes V2 (Vw=V2). The second diode drive voltage V2 is set to a voltage at which the switching transistor 27 is turned on. By turning-on of the switching transistor 27, the gate voltage Vg of the drive TFT 22 is changed from Vdata to V2−Vf. Here, Vf designates a voltage drop of the forward direction of the switching transistor 27. By setting the gate voltage Vg=V2−Vf of the drive TFT 22 to a value exceeding a source voltage Vs=Va of the drive TFT 22 (that is, V2−Vf>Va), the gate-source voltage Vgs of the drive TFT 22 becomes Vgs=(V2−Vf)−Va>0, and hence the reverse bias voltage (Vr=(V2−Vf)−Va) can be applied. In this manner, by applying the diode drive voltage Vw to the bias line (that is, to the electrode E2 of the switching transistor 27) so that the gate voltage Vg of the drive TFT 22 exceeds the source voltage Vs of the drive TFT 22, the drive TFT 22 can be set to the reversely biased state, which is effective for reducing the shift of a threshold voltage (Vth) of the drive TFT 22 and alleviation of the gate stress.

Alternatively, by setting the gate voltage Vg=V2−Vf of the drive TFT 22 to be the same as the source voltage Vs=Va of the drive TFT 22 (that is, V2−Vf=Va), the gate-source voltage can be adjusted to 0V (Vr=0). In this manner, the shift of the threshold voltage (Vth) of the TFT can be reduced also by setting the gate voltage Vg of the drive TFT 22 identical to the source voltage Vs of the drive TFT 22.

The application period (Tr) of the reverse bias voltage (Vr>0 or Vr=0) can be set as desired.

In this embodiment, since the diode drive voltage Vw can be changed for each scanning line, the timing of application of the reverse bias voltage Vr to the drive TFT 22 can be adjusted for each scanning line. For example, since the light-emitting device (OEL) 25 does not emit light while the reverse bias voltage Vr is applied to the drive TFT 22, the same time period (Td) from the initiation of application of the scanning pulse SP to the application of the diode drive voltage Vw=V2 is set to the respective scanning lines, the same light-emitting period (Td) can be set to the respective scanning lines. Alternatively, by differentiating the light-emitting period for the respective scanning lines by setting different periods (Td) for the respective lines (that is, Td1, Td2, . . . , Tdn), the light-emitting period can also be controlled.

By controlling the light-emitting period as described above, the luminance of the entire display panel 11 can be adjusted. It is also possible to use the control of the light-emitting period for setting a subfield period and hence utilizing the same for a gray-scale control. For example, the controller 15 may determine the light-emitting period (Td) corresponding to the luminance of the display panel 11 on the basis of the input video signal or a user's luminance specifying signal, and control the timing of application of the reverse bias voltage Vr. Alternatively, when performing the display control by means of a subfield method, the controller 15 may determine a desired subfield period to perform the gray-scale control.

Although the case in which the period Td is longer than the address periods in the respective frames (Tadr<Td) is shown as an example (FIG. 5), it is also possible to set the period Td to a time shorter than the address period (Tadr>Td, or Tadr=Td). Furthermore, the application time period (Tr) of reverse bias voltage (Vr>0) can also be set as desired for the respective scanning lines.

Second Embodiment

Figure 7:
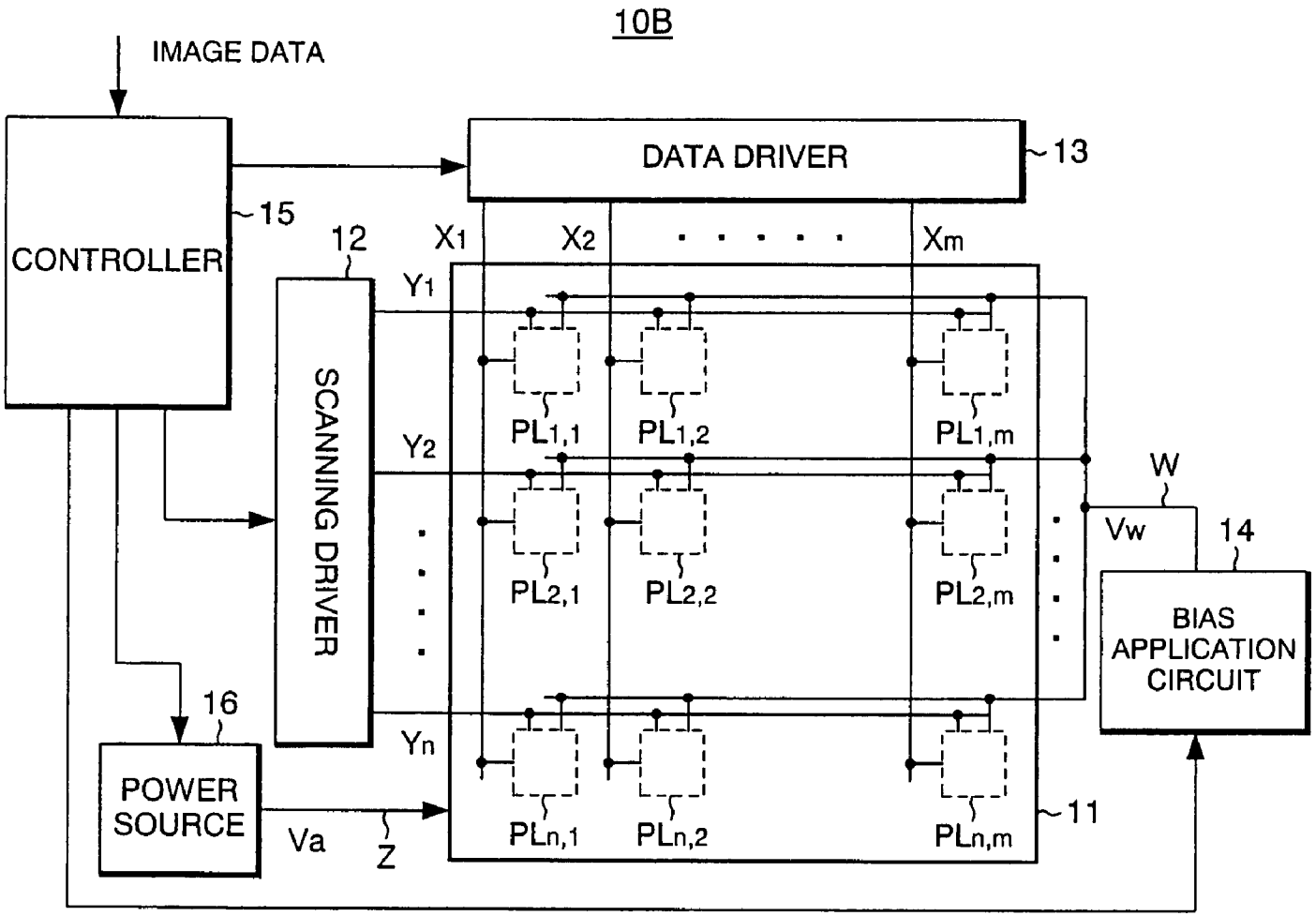
FIG. 7 is a block diagram showing a display device using an active matrix display panel according to a second embodiment of the present invention.

FIG. 7 shows a display device 10B using the active matrix display panel according to the present invention.

As shown in FIG. 7, in this embodiment, the electrodes E2 of the switching transistors 27 of all the pixel units $PL_{1,1}$ to $PL_{n,m}$ are connected to the bias application circuit 14 via the bias line W. In other words, the bias line W is configured as a common connecting line for the switching transistors 27 of all the pixel units $PL_{1,1}$ to $PL_{n,m}$ in the display panel 11. All the switching transistors 27 in the display panel 11 are connected so that the same diode drive voltage (Vw) is applied from the bias application circuit 14. The output voltage (power-source voltage) of the drive power source 16 of the light-emitting device is controlled by the controller 15.

Figure 8:
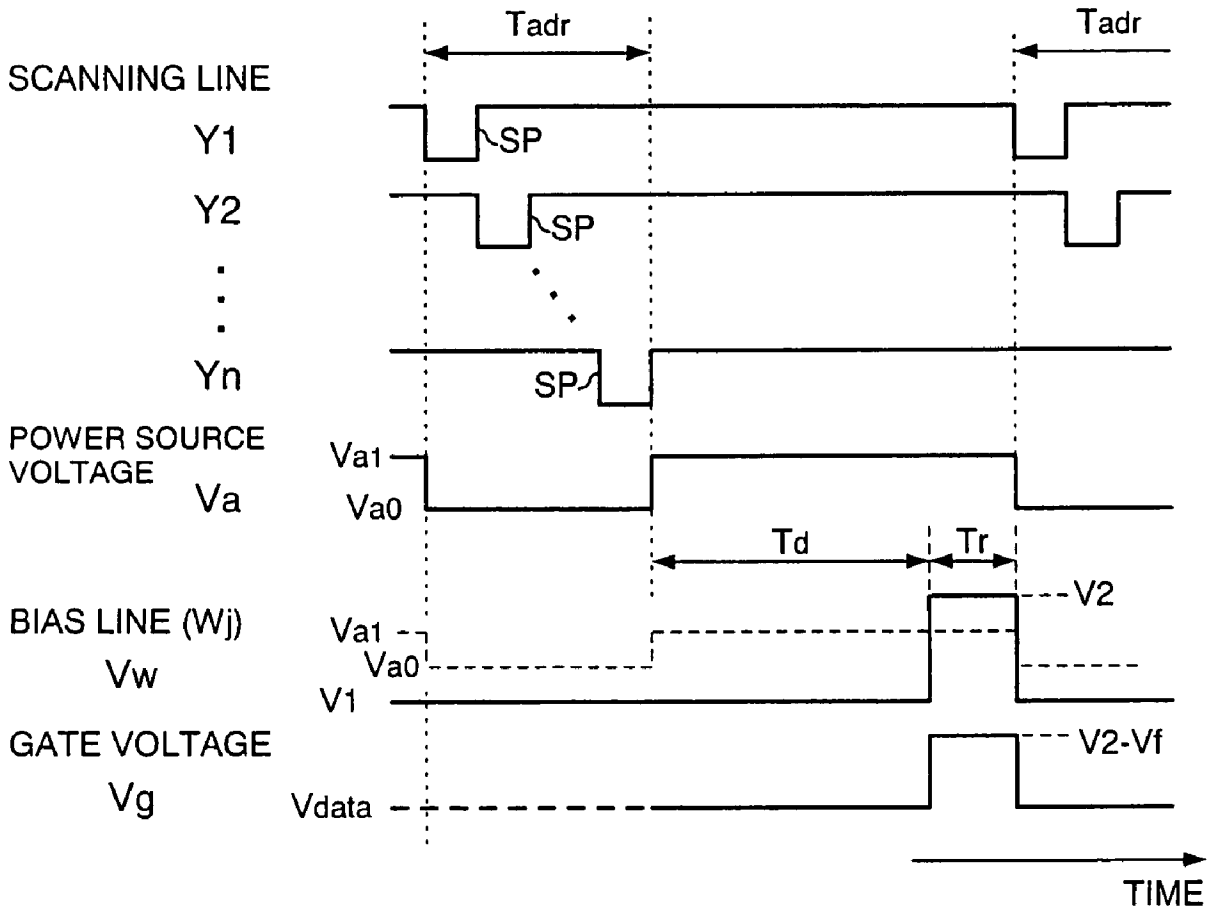
FIG. 8 is a timing chart schematically showing application timings of the scanning pulses applied to the respective scanning lines Y1-Yn of the display device shown in FIG. 7, a power-source voltage, and the diode drive voltages Vw, and the gate voltage of the drive TFT.

FIG. 8 is a timing chart schematically showing the scanning pulses SP applied to the respective scanning lines Y1 to Yn, the power-source voltage to be supplied to the light-emitting device (OEL) 25 via the power source line Z, the diode drive voltage Vw and the gate voltage Vg to be applied to the bias line W in the display panel 11.

In the respective frames of the input video signal, the scanning pulses SP are applied to the first to the $n^{th}$ scanning lines (Y1 to Yn) in sequence, and the sequential line scanning is carried out. The time required for scanning one frame is the address period (Tadr). The second embodiment is the same as the first embodiment in that the data signals DP which indicate luminance for the respective pixels are applied via the data lines X1 to Xm (not shown) corresponding to the sequential line scanning, so that control of the image display on the display panel 11 is achieved. In other words, the data is written into the respective pixels in the address period (Tadr) (data writing period).

In this embodiment, in the address period (or data writing period), the power-source voltage (Va) supplied to the light-emitting devices 25 of all the pixels is maintained at a low voltage (Va0) at which the light-emitting device 25 does not emit light. This is because, in this embodiment as described later, the reverse bias voltage is applied simultaneously to the switching transistors 27 of all the pixels, and the light-emitting devices 25 of all the pixels are controlled to emit light simultaneously after the data is written. The power-source voltage (Va) is switched to a high voltage (Va1) for causing the light-emitting device 25 to emit light from the low voltage (Va0) after the address period is terminated. The switching of the power-source voltage (Va) is controlled by the controller 15 described above.

The diode drive voltage Vw=V1 (first diode drive voltage) applied to the switching transistor 27 when performing display is supplied to the bias line W. The first diode drive voltage is set to a voltage at which the switching transistor 27 is turned off. More specifically, the first diode drive voltage V1 is set to a predetermined voltage of magnitude at which the drive TFT 22 can cause the light-emitting device 25 to emit light when the power-source voltage (Va) is set to the high voltage (Va1) that can cause the light-emitting device 25 to emit light and the data signal voltage (Vdata) is applied to the gate of the drive TFT 22 is set.

In the embodiment, the applied voltage to the bias line W is changed after the predetermined time (Td) is elapsed from the termination of the scanning of the first to the $n^{th}$ scanning lines (Y1 to Yn)(address period: Tadr). In other words, the second diode drive voltage Vw=V2 is applied from the bias application circuit 14 via the bias line W to the electrode E2 of the switching transistor 27. In other words, the second diode drive voltage V2 is simultaneously applied to the switching transistors 27 of all the pixel units. The second diode drive voltage V2 is set to the voltage at which the switching transistors 27 are turned on. By turning-on of the switching transistors 27, the voltage of the electrode (E1) which is connected to the gate of the drive TFT 22, that is, the gate voltage Vg of the drive TFT 22 is changed from Vdata to V2−Vf. Here, Vf is the voltage drop in the forward direction of the switching transistor 27.

In this instance, by setting the gate voltage Vg=V2−Vf of the drive TFT 22 to the value exceeding the source voltage Vs=Va of the drive TFT 22 (that is, V2−Vf>Va), the gate-source voltage Vgs of the drive TFT 22 becomes Vgs=(V2−Vf)−Va>0, so that the reverse bias voltage (Vr=(V2−Vf)−Va) can be applied to the drive TFT 22. In this manner, by applying the diode drive voltage Vw to the bias line (that is, the electrodes E2 of the switching transistors 27) so that the gate voltage Vg of the drive TFT 22 exceeds the source voltage Vs of the drive TFT 22, the drive TFT 22 can be set into the reversely biased state, whereby the shift of the threshold voltage (Vth) of the drive TFT 22 can be reduced.

Alternatively, by setting the gate voltage Vg=V2−Vf of the drive TFT 22 to be the same as the source voltage Vs=Va of the drive TFT 22 (that is, V2−Vf=Va), the gate-source voltage can be adjusted to 0V (Vr=0). In this manner, the shift of the threshold voltage (Vth) of the TFT can be reduced also by setting the gate voltage Vg of the drive TFT 22 identical to the source voltage Vs of the drive TFT 22.

In the embodiment, the light-emitting devices 25 of all the pixels emits light in the predetermined period (Td) until the switching transistors 27 are turned on by the application of the second diode drive voltage V2 from the termination of the address period (Tadr). Therefore, by changing the predetermined period (Td), the light-emitting period can be controlled. By controlling the light-emitting period, the luminance of the entire display panel 11 can be adjusted.

Since the reverse bias application period (Tr) during which the reverse bias voltage (Vr>0 or Vr=0) is applied can be set as desired, the light-emitting period can also be controlled by adjusting the reverse bias application period (Tr), and hence the luminance of the entire display panel 11 can be adjusted.

For example, the controller 15 can reduce the shift of the threshold voltage (Vth) of the TFT and perform adjustment of the luminance of the entire screen of the display device by determining the light-emitting period (Td) and the reverse bias application period (Tr) corresponding to the luminance of the display panel 11 on the basis of the input video signal or the user's luminance specifying signal.

Third Embodiment

Figure 9:
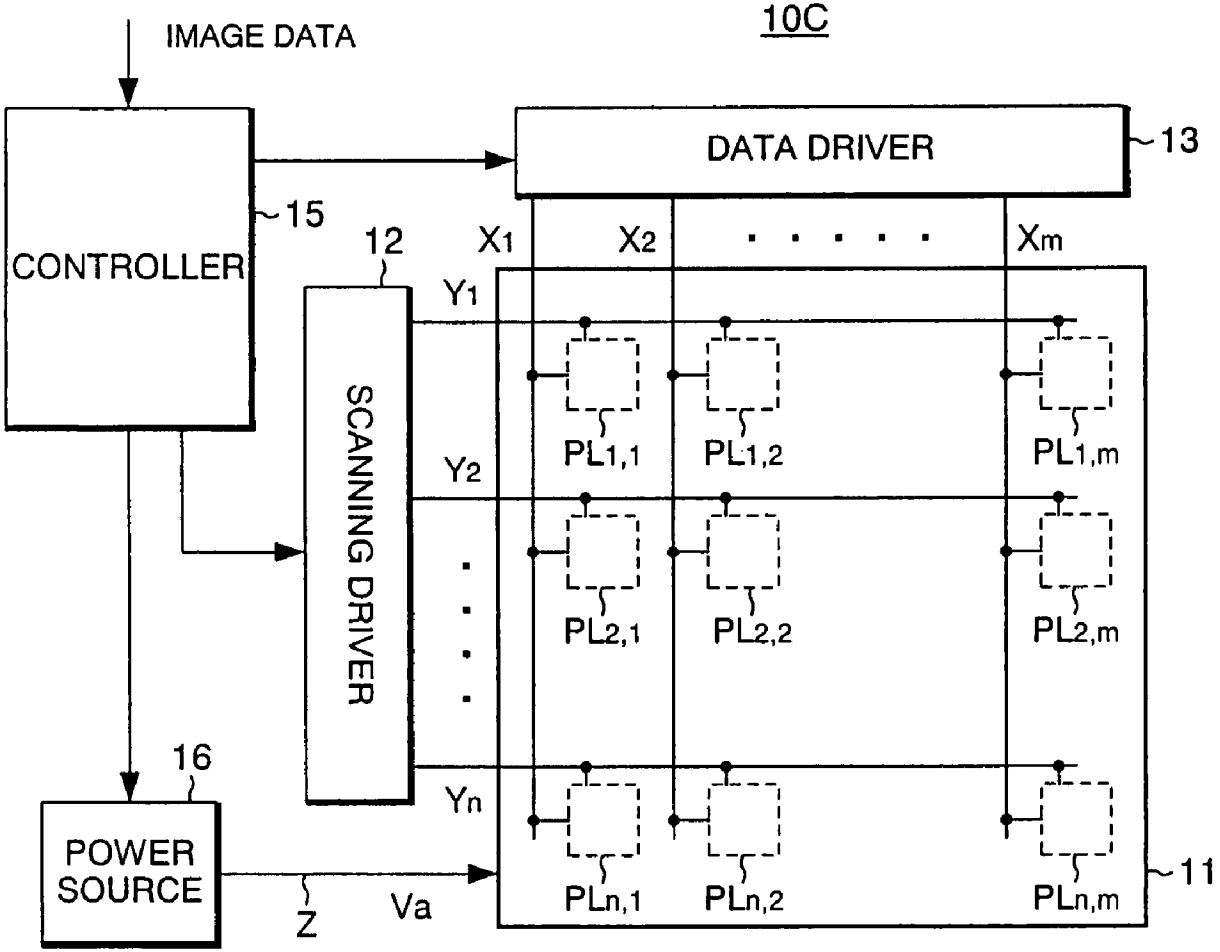
FIG. 9 is a block diagram showing a display device using an active matrix display panel according to a third embodiment of the present invention.

FIG. 9 shows a display device 10C using the active matrix display panel according to the present invention. This embodiment is different from the above-described embodiments in that the bias application circuit 14 and the connecting lines (bias lines) W1 to Wn connected to the bias application circuit 14 are not provided. Additionally, the selection transistor 21 and the drive transistor 22 are of the conduction types opposite to each other in polarity. In this embodiment, a case in which the selection transistor 21 and the switching transistors 27 are the N-channel TFT, and the drive transistor 22 is the P-channel TFT will be described as an example. The conduction types of the transistors 21, 22, 27 are not limited thereto, and may be selected as needed.

In the embodiment, the scanning pulse voltage applied to the scanning line Yj is used as the diode drive voltage. In the following description, for the sake of simplification of description and easiness of understanding, the scanning pulse voltage applied to the switching transistor 27 on the scanning line Yj will be described as a diode drive voltage VSj.

Figure 10:
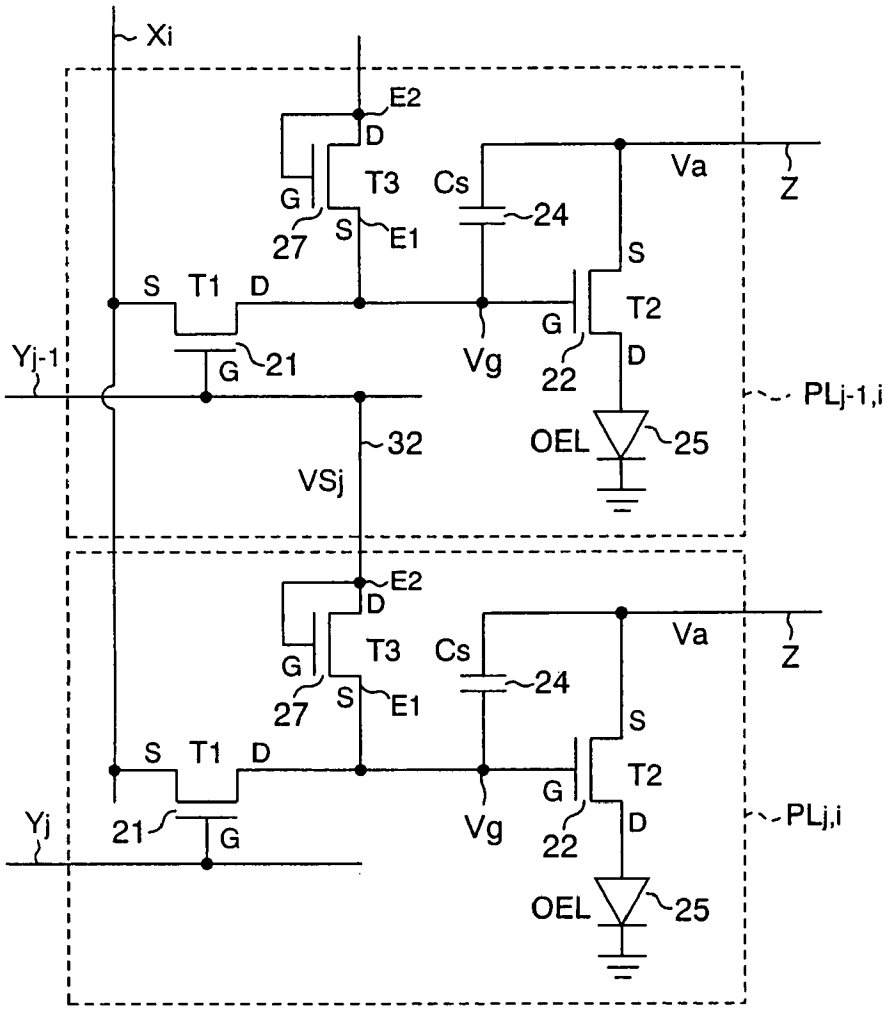
FIG. 10 is a drawing schematically showing a configuration of circuits of the pixel units $PL_{j-1,i}$ and $PL_{j,i}$ in the display panel according to the third embodiment.

FIG. 10 schematically shows the circuit configurations of the pixel units $PL_{j-1,i}$ and $PL_{j,i}$ adjacent to each other in the direction of the column in the display panel 11 according to the embodiment. As shown in FIG. 10, in the embodiment, the electrode (E2) of the switching transistor 27 to which the diode drive voltage Vw is applied is connected to the previous scanning line. More specifically, the electrode E2 of the switching transistor 27 of the pixel unit $PL_{j,i}$ on the $j^{th}$ scanning line Yj is connected to the $(j-1)^{th}$ scanning line Yj−1 by a connecting line 32 (j=2 to n). As regards the pixel unit $PL_{1,j}$ of the first raw (j=1), in this embodiment, a case in which the switching transistor 27 is not provided therein, or it is not connected to other scanning lines will be described. However, it is also possible to provide a connecting line for applying the diode drive voltage to the switching transistor 27 of the pixel unit $PL_{1,j}$ of the first raw (j=1) in the display panel 11. In this case, the scan driver 12 carries out the sequential line scanning, assuming that the connecting line in question is the previous scanning line of the scanning line of the first row (the first scanning line). Alternatively, it is also possible to connect the switching transistor 27 provided in the pixel unit of the first row to the last ($n^{th}$) scanning line. Other circuit configurations and connection of the respective elements are the same as those in the above-described embodiments.

Figure 11:
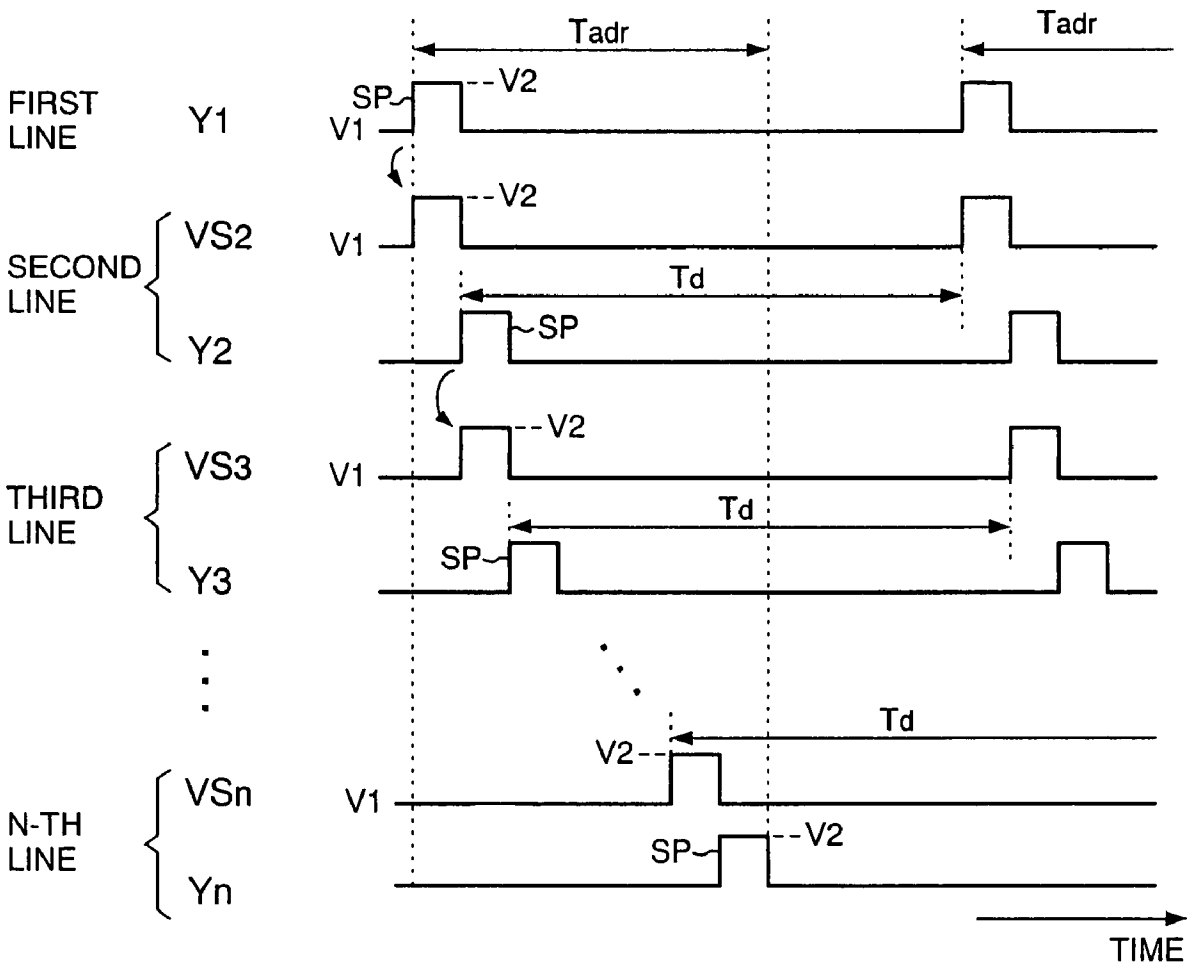
FIG. 11 is a timing chart schematically showing the application timings of the scanning pulses applied to the respective scanning lines Yj in the display panel and the scanning pulses of the previous lines supplied to the respective scanning lines Yj.

FIG. 11 is a timing chart schematically showing the application timings of the scanning pulses SP to be applied to the respective scanning lines Yj or the scanning pulses of the previous line applied to the respective scanning lines Yj (j=2 to n) in the display panel 11. For example, in the second scanning line Y2, the scanning pulse of the previous line (first scanning line Y1) is applied to the pixel unit on the scanning line Y2 as the diode drive voltage VS2. Subsequently, the scanning pulse SP is applied to the second scanning line Y2. The scanning and the application of the diode drive voltage in this manner are carried out in sequence, and the sequential line scanning is carried out. In the address period in the next frame, the light-emitting devices 25 on the respective scanning lines Yj are driven to emit light according to the data signals over time period (Td) until the scanning pulses of the previous lines (that is, the diode drive voltage VS) are applied to the respective scanning lines.

Figure 12:
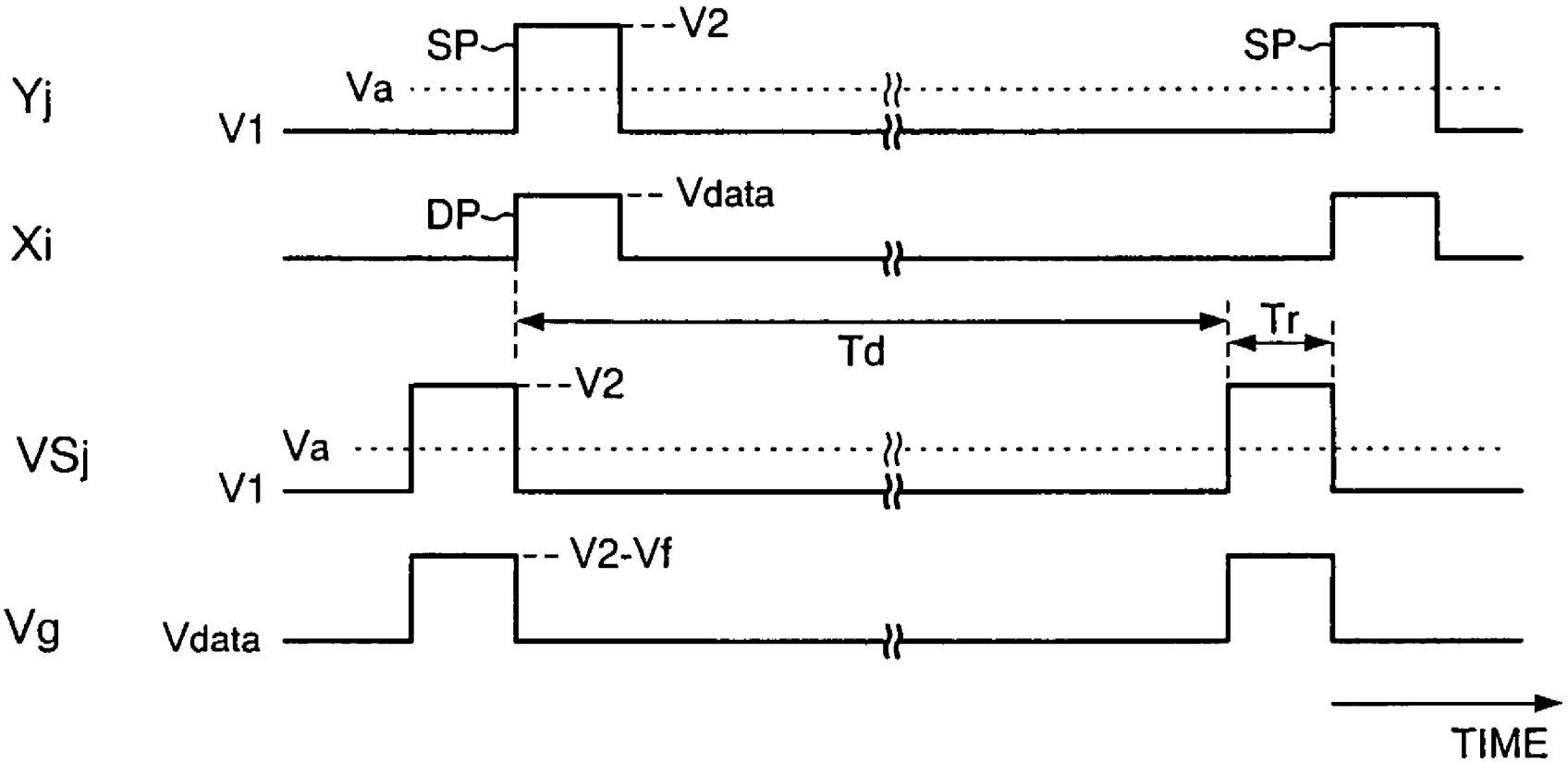
FIG. 12 is a schematic timing chart showing scanning pulse signals, data voltage signals, diode drive voltages VSj, and the gate voltages of the drive TFT to the respective pixel units $PL_{j,i}$.

Subsequently, referring to FIG. 12, the scanning pulse signals to each $PL_{j,i}$, the data voltage signal, the diode drive voltage VSj, the gate voltage and the gate-source voltage of the drive TFT 22 in detail. In FIG. 12, description will be made for the $j^{th}$ scanning line Yj as an example.

When the scanning pulse SP is applied to the scanning line Yj of the pixel unit $PL_{j,i}$ and the scanning line Yj is selected, the selection TFT 21 is turned on, and the pixel data signal pulse DP (data voltage Vdata) from the data driver 13 is supplied to the gate of the drive TFT 22 via the selection TFT 21. At this time, the diode drive voltage VSj applied to the switching transistor 27 on the scanning line Yj is VSj=V1 (first diode drive voltage). The first diode drive voltage is the voltage at which the switching transistor 27 is turned off (OFF).

Here, since the power-source voltage Va (>0) is supplied to one of the electrodes of the capacitor (Cs) 24, the electric charge corresponding to the voltage Va−Vdata is accumulated in the capacitor 24, and the voltage corresponding to the electric charge is held (referred to as "holding voltage"). Then, the gate as the control electrode of the drive TFT 22 is controlled by the capacitor holding voltage. More specifically, the drain current according to the gate-source voltage Vgs (=Vdata−Va<0) flows to the drive TFT 22. Therefore, the light-emitting device 25 is driven and emits light at a luminance according to the pixel data signal (data voltage Vdata).

The scanning pulse SP of the previous scanning line Yj−1 of the scanning line Yj is applied to the switching transistor 27 on the scanning line Yj as the diode drive pulse (voltage VSj) after the next frame period is started and immediately before the scanning pulse SP is applied to the scanning line Yj. In other words, the applied voltage to the switching transistor 27 on the scanning line Yj is changed, and the diode drive voltage VSj becomes VSj=V2. The second diode drive voltage V2 is set to the voltage at which the switching transistor 27 is turned on. By turning-on of the switching transistor 27, the gate voltage Vg of the drive TFT 22 is changed from Vdata to V2−Vf. Here, reference sign Vf designates the voltage drop in the forward direction of the switching transistor 27. By setting the gate voltage Vg=V2−Vf of the drive TFT 22 so as to exceed the source voltage Vs=Va of the drive TFT 22 (that is, V2−Vf>Va), the gate-source voltage Vgs of the drive TFT 22 becomes Vgs(V2−Vf)−Va>0, and the reverse bias voltage (Vr=(V2−Vf)−Va) can be applied. Since the drive TFT 22 is set into the reversely biased state by the application of the diode drive voltage VSj=V2, the light-emitting device 25 is extinguished.

In this manner, the drive TFT 22 can be set into the reversely biased state by applying the diode drive voltage Vw to the bias line so that the gate voltage Vg of the drive TFT 22 exceeds the source voltage Vs of the drive TFT 22 (that is, the electrode E2 of the switching transistor 27), so that the shift of the threshold voltage (Vth) of the drive TFT 22 can be reduced.

Alternatively, by setting the gate voltage Vg=V2−Vf of the drive TFT 22 to be the same as the source voltage Vs=Va of the drive TFT 22 (that is, V2−Vf=Va), the gate-source voltage can be adjusted to 0V (Vr=0). In this manner, the shift of the threshold voltage (Vth) of the TFT can be reduced also by setting the gate voltage Vg of the drive TFT 22 identical to the source voltage Vs of the drive TFT 22.

In the embodiment, the light-emitting device 25 emits light during the predetermined period (Td) from the application of the scanning pulse SP and the data voltage to the application of the scanning pulse to the previous scanning line in the next frame period.

Since the application period (Tr) of the reverse bias voltage (Vr>0 or Vr=0) described above can be set as desired, the luminance can be adjusted also by adjusting the reverse bias application period (Tr).

For example, the controller 15 can reduce the shift of the threshold voltage (Vth) of the TFT and perform adjustment of the luminance of the entire screen of the display device by determining the light-emitting period (Td) and the reverse bias application period (Tr) corresponding to the luminance of the display panel 11 on the basis of the input video signal or the user's luminance specifying signal.

What is claimed is:

1. A display device, comprising:

an active matrix display panel including a plurality of pixel units each having a light-emitting device, a capacitor for holding a data signal, and a drive transistor for driving the light-emitting device on a basis of a held data signal;

a scanning unit for carrying out a sequential line scanning for respective scanning lines in the display panel;

a data drive unit for supplying the data signal to the pixel unit according to the scanning of the scanning unit; and a two-terminal switching device provided on each of the plurality of pixel units and connected at a first terminal to a control electrode of the drive transistor and at a second terminal to a one-line previous scanning line scanned by the scanning unit, the two-terminal switching device being turned on according to a magnitude of a scanning voltage applied to a second terminal to supply the scanning voltage to the control electrode, wherein the scanning unit carries out the sequential line scanning by a scanning pulse signal having a bias voltage of a magnitude which can set the drive transistor into a reversely biased state.

2. The display device according to claim 1, further comprising a control unit for controlling a light-emitting period of the light-emitting device by adjusting a pulse width of the scanning pulse signal.

3. The display device according to claim 1, further comprising an additional connecting line connected to the second terminal of the two-terminal switching device provided in the pixel unit on a first row in the sequential line scanning, the scanning unit carrying out the sequential line scanning in a manner such that the additional connecting line comprises the one-line previous scanning line of the scanning line of the first row.

4. The display device according to claim 1, wherein the two-terminal switching device provided in the pixel unit on a first row in the sequential line scanning is connected to a last scanning line in the sequential line scanning.

5. The display device according to claim 1, wherein the second terminal of the two-terminal switching device of said each of the plurality of pixel units is connected to said one-line previous scanning line via a connecting line, and wherein said connecting line is coupled to a gate of a selection transistor of an adjacent pixel unit to said each of the plurality of pixel units.

6. The display device according to claim 1, wherein the drive transistor is reverse-biased with the sequentail-line-scanning.

7. The display device according to claim 1, wherein the two-terminal switching device comprises a transistor of a diode-connection, in which a drain and gate of the two-terminal switching device are coupled to each other.

8. The display device according to claim 7, wherein a direction in which a positive voltage is applied to the second terminal is a forward direction.

9. The display device according to claim 1, wherein a source of the drive transistor is connected to a node that is placed in a connecting line that connects one end of the capacitor to a power source, and wherein a drain of the driver transistor is coupled to the light-emitting device, the capacitor being coupled to said source of the drive transistor via said node.

10. The display device according to claim 1, wherein the first terminal of the two-terminal switching device of said each of the plurality of pixel units is connected to another scanning line of the sequential line scanning, said one-line previous scanning line being connected to a selection transistor of an adjacent pixel unit to said each of the plurality of pixel units.

* * * * *